United States Patent [19]

Campbell

[11] 4,433,830

[45] Feb. 28, 1984

[54] LIFTING SYSTEM FOR A TURBINE DISC

[75] Inventor: Ira J. Campbell, East Bradford, Pa.

[73] Assignee: Westinghouse Electric Corp., Pittsburgh, Pa.

[21] Appl. No.: 327,152

[22] Filed: Dec. 3, 1981

[51] Int. Cl.[3] ..... B66D 3/00

[52] U.S. Cl. ..... 254/264; 294/67 A

[58] Field of Search ..... 254/264, 278, 283–286, 254/334–338, 401–404, 409–412; 294/67 A, 67 AA, 86 LS, 92

[56] References Cited

U.S. PATENT DOCUMENTS

| | | | |
|---|---|---|---|
| 1,695,960 | 12/1928 | Hackworth et al. | 294/67 A |
| 3,123,392 | 3/1964 | Jacobson | 294/92 X |
| 3,671,015 | 6/1972 | Sullivan | 254/334 X |

FOREIGN PATENT DOCUMENTS

| | | | |
|---|---|---|---|
| 230008 | 3/1910 | Fed. Rep. of Germany | 254/401 |
| 361967 | 11/1973 | U.S.S.R. | 294/86 LS |
| 596530 | 2/1978 | U.S.S.R. | 294/86 LS |
| 706309 | 1/1980 | U.S.S.R. | 294/67 A |

*Primary Examiner*—John M. Jillions

*Attorney, Agent, or Firm*—F. J. Baehr, Jr.

[57] ABSTRACT

A system for lifting a turbine disc having a mounting flange or balance ring, the system comprising a fixture having a base which attaches to the flange or balance ring, in elongated portion which extends beyond the periphery of the disc and a cantilevered portion extending from the distal end of the elongated portion and over the tips of the blades, eyelets disposed on the cantilevered portion and on the lower portion of the disc. The eyelets on the cantilever portion are disposed over the center of gravity of the assembly and a pair of hoists attached to the eyelets to lift the disc and move it to any orientation without damaging the blades.

5 Claims, 4 Drawing Figures

LIFTING SYSTEM FOR A TURBINE DISC

BACKGROUND OF THE INVENTION

This invention relates to a steam turbine and more particularly to a system for lifting and orienting turbine discs.

As steam turbines became larger, the rotors could no longer be formed from a single forging and it became standard practice to fit a disc with a circular array of blades over the shaft. The discs were either shrunk on the shaft or bolted thereto via a flange disposed on the disc. These discs have experienced stress corrosion requiring repair and/or replacement.

SUMMARY OF THE INVENTION

In general, a lifting system for a turbine disc having a circular array of blades and a flange with a plurality of holes disposed in the flange, when made in accordance with this invention, comprises a base portion having holes which register with the holes in the flange, the base being disposed on the upper part of the flange, an elongated portion which extends from the base to beyond the outer periphery of the blades, a cantilevered portion which extends from the distal end of the elongated portion and over the blades. The system also comprises an eyelet for receiving a hoist disposed on the cantilever portion and generally aligned with the center of gravity of the disc and a second eyelet disposed on the lower portion of the flange. The system further comprises a main hoist for lifting the disc attached to the first eyelet and an auxiliary hoist capable of lifting at least a portion of the disc attached to the second eyelet whereby the disc can be easily moved from a vertical to a horizontal orientation and vice versa and lifted and held in any orientation without damaging the blades.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 2:
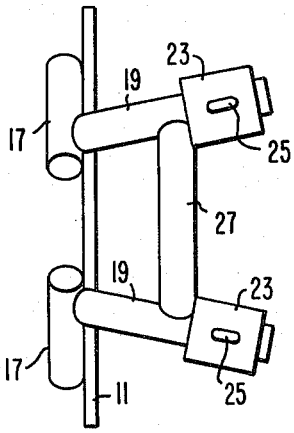
FIG. 2 is a plan view of the lifting fixture.

Referring now to the drawings in detail and in particular to FIGS. 1 through 4, there is shown a system for lifting a turbine disc 3 having a mounting flange 5 on one end for fastening the disc to the shaft (not shown) and a balance ring 7 on the other end. The balance ring 7 resembles a slip-on flange. The mounting flange 5 and balance ring 7 each have holes 9 spaced on a predetermined bolt circle. The lifting system comprises a lifting fixture which has an arcuate-shaped base 11 with holes disposed therein that register with the holes 9 in the mounting flange 5 and the balance ring 7. Bolts or other fasteners are utilized to fasten the base plate 11 to either the mounting flange 5 or the balance ring 7. Extending along and outwardly from the base 11 are elongated tubular members 17, which extend beyond the tips or periphery of the blades. The elongated tubular members 17 tend to converge as they extend from the base. Cantilevered tubular members 19 are attached to the distal ends of the elongated tubular members 17 by welding or other means. Gussets 21 are disposed at the juncture of the elongated and cantilevered tubular members 17 and 19. Reinforcing plates 23 are welded to the cantilevered tubular members 19 and an eyelet 25 or other means for receiving a cable or hoist hook are disposed in the reinforcing plate 23 and are generally aligned with the center of gravity of the disc and lifting fixture. A cross member or brace 27 is disposed between the cantilevered members 19 and is attached thereto by welding or other means.

Figure 1:
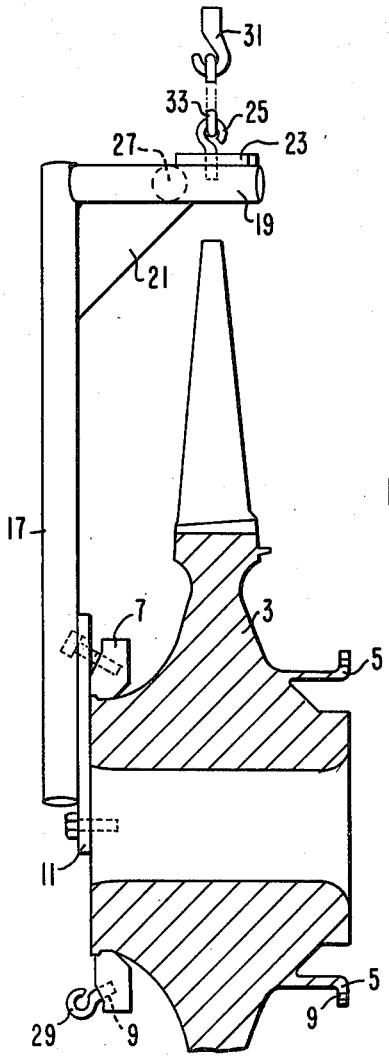
FIG. 1 is an elevational view of a lifting fixture and a partial sectional view of a turbine disc.
Figure 3:
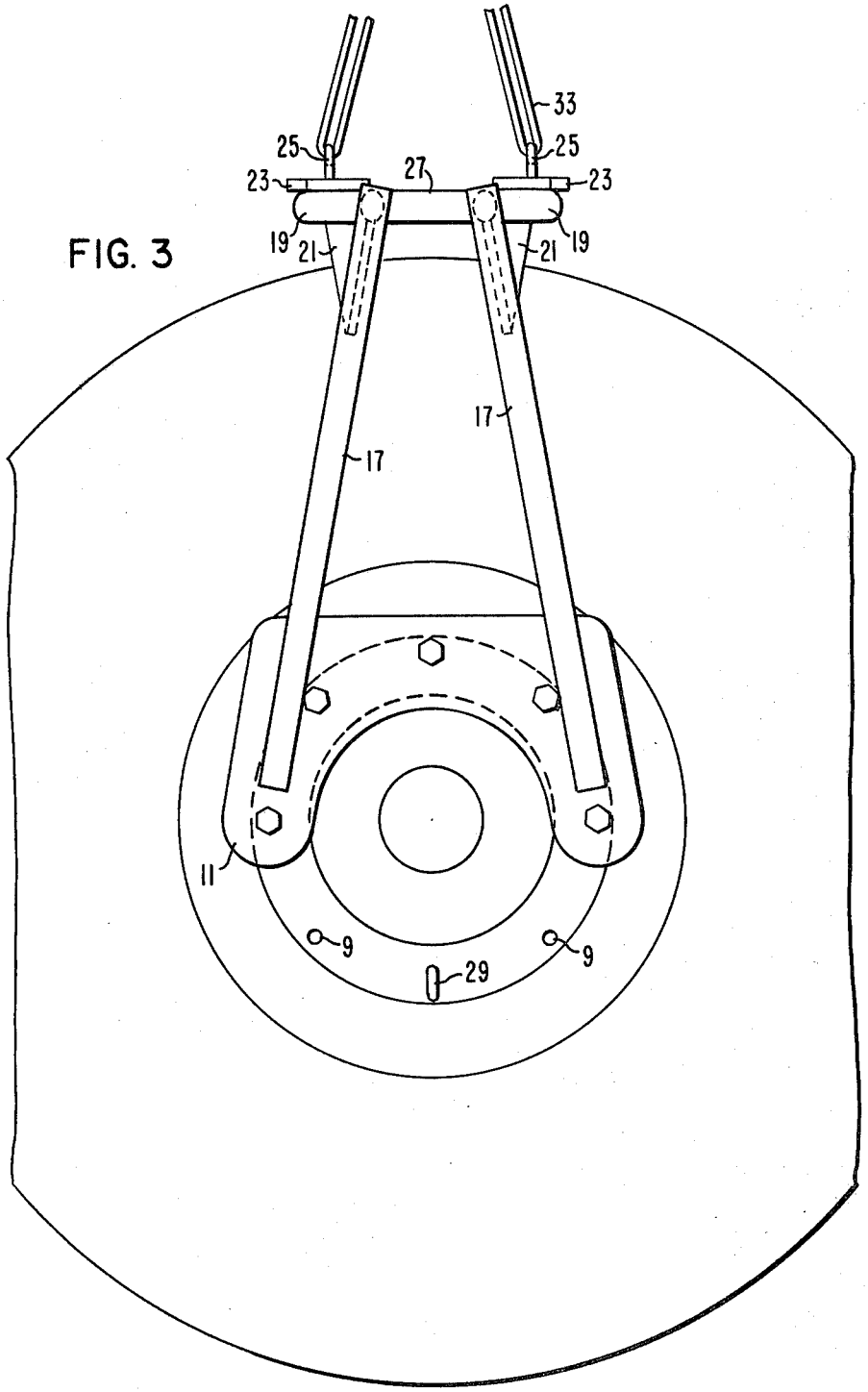
FIG. 3 is an elevational view of a lifting fixture and disc.
Figure 4:
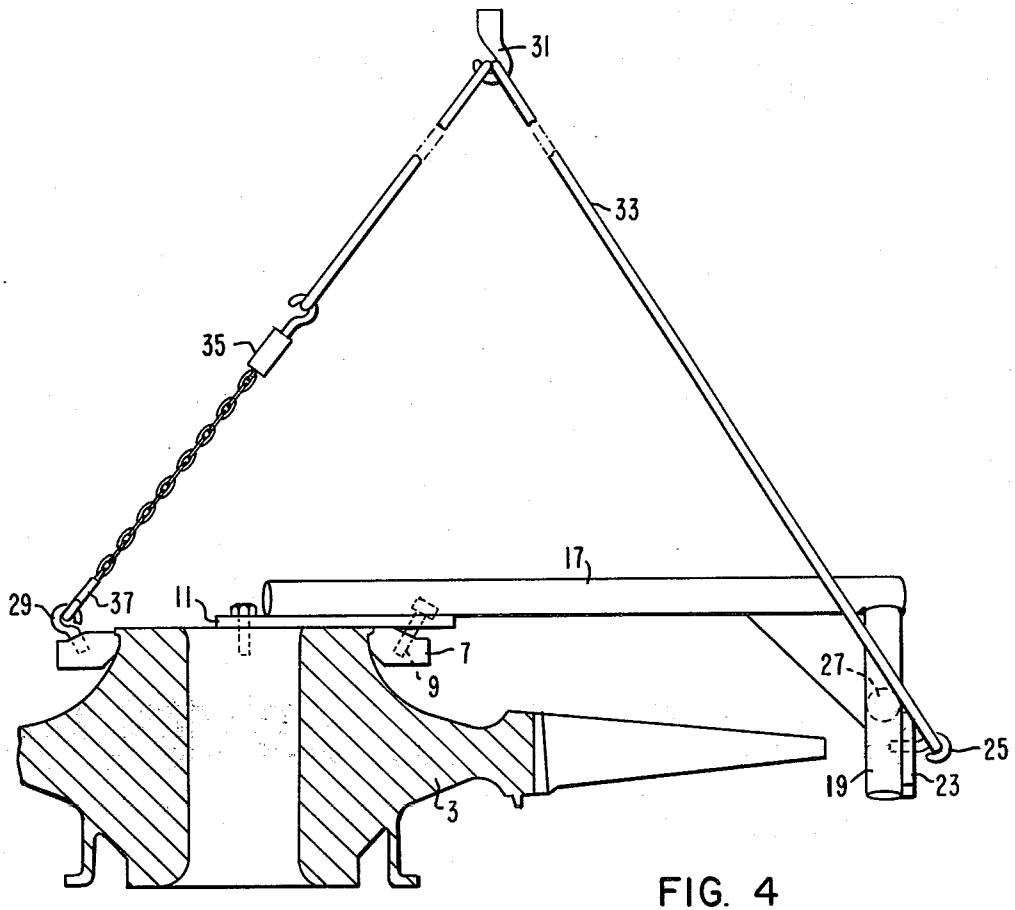
FIG. 4 is an elevational view of the lifting fixture and disc showing two hoists.

An eyelet 29 or other means for receiving a cable or hook of a hoist is disposed on the lower portion of the balance ring 7 or flange 5 and as shown in FIGS. 1 and 4, a hoist or crane, only the hook 31 of which is shown, is connected to the eyelet 25 by a cable 33. The hoist is capable of lifting the disc and generally the entire rotor. An auxiliary hoist 35 such as a chain fall or come-along is also suspended from the hook 31 and its hook 37 or a cable is attached to the eyelet 29. By operating the auxiliary hoist 35, the disc can easily have its orientation change from vertical to horizontal or vice versa or it may be lifted in any orientation and held there without damage to the blades.

What is claimed is:

1. A lifting system for a turbine disc having a circular array of blades having a generally circular outer periphery and a plurality of holes disposed in said turbine disc, said lifting system comprising a base portion having holes which register with said holes in the turbine disc, said base being disposed on the upper portion of the disc;

an elongated portion which extends from the base portion to beyond the outer periphery of the blades;

a cantilevered portion which extends from the distal end of the elongated portion and over the outer periphery of the blades;

a first means for receiving a hoist disposed on said cantilevered portion and generally aligned with the center of gravity of the disc;

a second means for receiving a hoist disposed on the lower portion of the disc;

a hoist for lifting said disc attached to said first hoist receiving means; and an auxiliary hoist capable of lifting at least a portion of said disc attached to said second hoist receiving means and attached to said first mentioned hoist, whereby the disc can be easily moved from a vertical to a horizontal orientation and vice versa and lifted and held in any orientation without damaging the tips of the blades.

2. A lifting system as set forth in claim 1, wherein the base portion is an arcuate-shaped plate.

3. A lifting system as set forth in claim 1, wherein the elongated portion comprises a pair of tubular members which tend to converge as they approach their distal end.

4. A lifting system as set forth in claim 3, wherein the cantilevered portion is formed of tubular members extending from the tubular elongated members and has gussets which stiffen the juncture therebetween.

5. A lifting system as set forth in claim 4, and further comprising a cross-member disposed between the tubular cantilevered members.

* * * * *